US007850099B2

(12) United States Patent
Jones

(10) Patent No.: US 7,850,099 B2
(45) Date of Patent: Dec. 14, 2010

(54) ELECTRONIC UNIT INJECTORS

(75) Inventor: Jerry A. Jones, Ravenna, OH (US)

(73) Assignee: Buescher Developments, LLC, Cleveland, OH (US)

( * ) Notice: Subject to any disclaimer, the term of this patent is extended or adjusted under 35 U.S.C. 154(b) by 92 days.

(21) Appl. No.: 12/201,059

(22) Filed: Aug. 29, 2008

(65) Prior Publication Data

US 2010/0051723 A1 Mar. 4, 2010

(51) Int. Cl.
*F02M 61/20* (2006.01)
*B05B 1/30* (2006.01)
*B05B 1/34* (2006.01)

(52) U.S. Cl. ..... 239/533.9; 239/533.14; 239/533.2; 239/533.7; 239/88; 239/585.1

(58) Field of Classification Search ..... 239/89, 239/88, 533.3, 585.1, 585.5; 29/890.13, 29/890.126, 890.124, 157
See application file for complete search history.

(56) References Cited

U.S. PATENT DOCUMENTS

| | | | | |
|---|---|---|---|---|
| 5,937,520 | A * | 8/1999 | Earhart et al. | 29/890.13 |
| 5,992,768 | A * | 11/1999 | Beatty et al. | 239/533.9 |
| 6,543,706 | B1 * | 4/2003 | Hutchings et al. | 239/533.3 |
| 6,811,092 | B2 | 11/2004 | Cowden | |
| 7,044,400 | B2 * | 5/2006 | Luedicke | 239/88 |
| 7,124,966 | B2 * | 10/2006 | Schlairet | 239/533.2 |

* cited by examiner

*Primary Examiner*—Len Tran
*Assistant Examiner*—James S Hogan
(74) *Attorney, Agent, or Firm*—Pearne & Gordon LLP

(57) ABSTRACT

An electronic unit injector comprising a spray tip including a valve seat, a needle valve arranged to close on the seat to prevent discharge of fuel from the spray tip or to open off the seat to dispense fuel from the spray tip, a spring biasing the needle valve to a closed position, a spring seat between the spring and the needle valve, the needle valve overcoming the biasing force when the pressure reaches a predetermined level, the spring and seat being disposed in a cage having port areas circumferentially arranged about said spring and spring seat to supply low pressure fuel to the area occupied by said spring and spring seat to reduce the risk of cavitation in said spring cage.

6 Claims, 3 Drawing Sheets

ELECTRONIC UNIT INJECTORS

BACKGROUND OF THE INVENTION

The invention relates to improvements in fuel injectors for diesel engines.

PRIOR ART

A common arrangement for diesel injector assemblies has a needle valve immediately upstream of the injector orifices biased closed by a spring. The needle valve is cyclically opened by an impulse of high pressure fuel operating on an area of the needle valve that opposes the biasing spring. The spring resides in a space, typically in a part of the injector assembly referred to as a spring cage that is exposed to fuel at low pressure levels. Exposing the spring space to fuel is done to avoid a need and the practical difficulty to completely seal it from the necessarily high injection pressures. A persistent and seemingly complex problem in an electronically controlled injector is cavitation in the valve spring space. This cavitation can lead to degradation of the spring and ultimate failure.

U.S. Pat. No. 6,811,092 is directed to the problem of cavitation in the spring cage of an electronic fuel injector. Experience has shown the solution proposed in this patent is not effective, at least in certain applications, in satisfactorily eliminating cavitation in the spring cage. The patent indicates an earlier described arrangement of a fuel injector assembly with a spring cage vented to a low pressure region of the injector to avoid a hydraulic lock had a potential for cavitation.

SUMMARY OF THE INVENTION

The invention relates to the discovery that cavitation in a spring cage of an electronic fuel injector can be effectively eliminated by affording a sufficient, positive supply of fuel to a critical area of the spring cage. Where the spring cage, as is conventional, is a hollow cylinder, it has been found effective to port the cage walls with an area that is at least a significant fraction of the area of the spring seat and, preferably, to provide this port area in an arrangement generally surrounding the spring seat. Additionally, it is desirable to provide a port area adjacent the end of the spring cage remote from the spring seat. By porting the spring cage at opposite ends, fuel more readily circulates in and out of the spring cage area thereby improving heat transfer, lowering temperature of fuel in the spring cage and reducing the risk of cavitation.

In the disclosed embodiment, the spring cage is arranged to be used with an original equipment manufactured nozzle nut or a duplicate thereof. As such, in its preferred embodiment, the spring cage of the invention is a hollow cylindrical body with an outside diameter sized to provide a large functional clearance with the inside diameter of the surrounding portion of the nozzle nut. The spring cage can be concentrically located on the axis of the nozzle nut bore, for example, by indexing it to a spray tip at a lower end and at an upper end to a spacer fitted to the nozzle nut bore. In their assembled state, the spring cage and nozzle nut form an annular fuel plenum surrounding the spring cage which freely communicates with all of the ports in the spring cage wall. The annular plenum serves as a local reservoir that can supply fuel and thereby reduce the tendency for cavitation to occur within the spring cage.

DESCRIPTION OF THE PREFERRED EMBODIMENT

Figure 1:
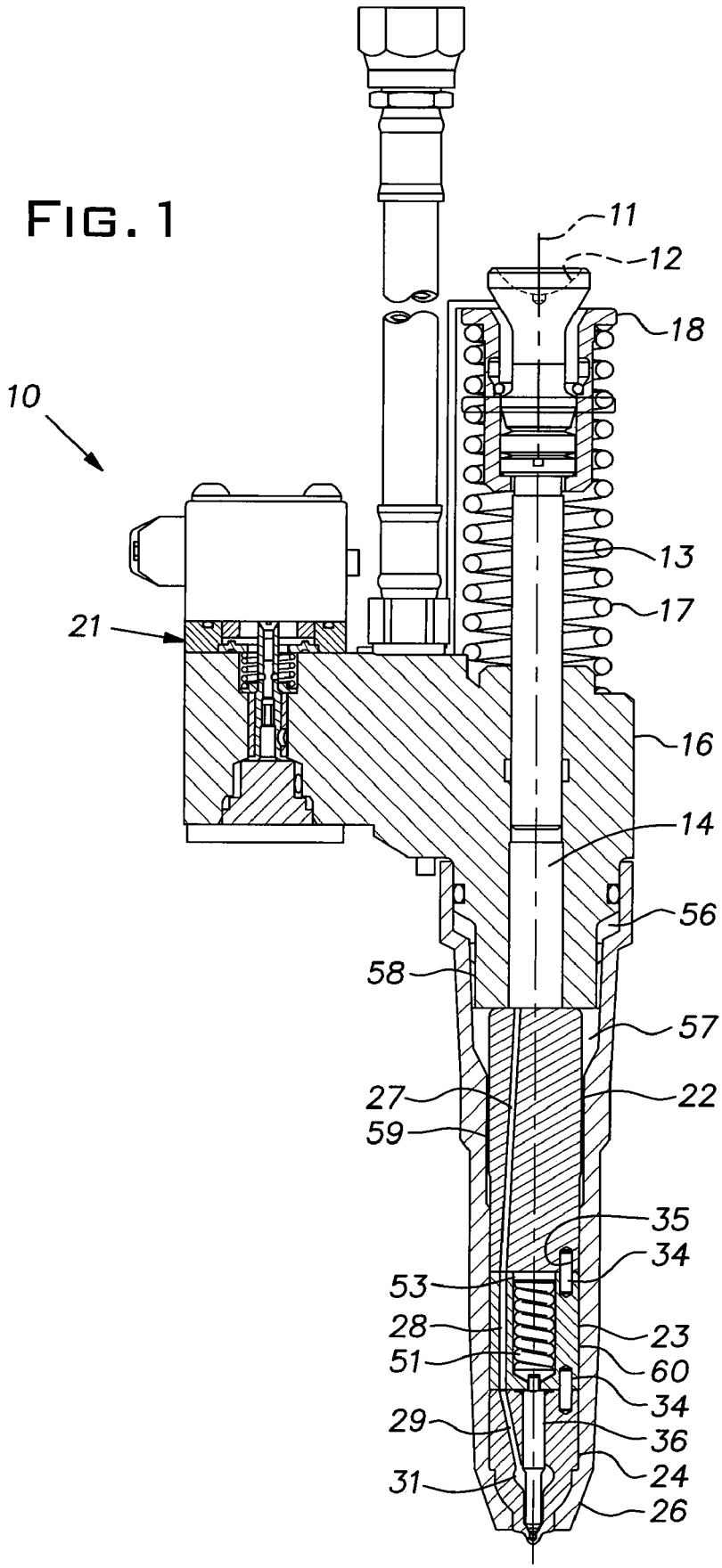
FIG. 1 is a cross-sectional view of an injector assembly taken in a longitudinal plane of its central axis.

An injector assembly 10 for introducing fuel to the cylinder of a diesel engine such as used in a railroad locomotive is illustrated in FIG. 1. The injector assembly 10 is installed on an engine in a known manner. The injector assembly 10 has a general construction like that of the prior art units shown in U.S. Pat. No. 6,811,092, the disclosure of which is incorporated herein by reference. As is common, a separate injector assembly 10 is provided for each cylinder of the engine.

Most of the components of the injector 10 are centered about an axis indicated at 11. At an upper end, the assembly 10 includes a plunger socket 12 that receives a lever mechanically operated in synchronization with the engine's crankshaft. The socket 12 drives a cylindrical plunger 13 down into a fuel pressurizing chamber 14 formed in a main body or housing 16 of the injector 10. A spring 17 encircling the top of the plunger 13 and operating through a retainer 18 returns the plunger from its fuel pressurizing stroke. Fuel is delivered into the chamber 14 by a distribution rail fed by a fuel supply pump in a known manner. The supply pressure of the fuel is relatively low, being typically in the range of about 105 psi. An electronically operated control valve 21 on the housing 16 is normally open and allows fuel being displaced from the chamber 14 by downward movement of the plunger 13 to be vented at low pressure to a return circuit. When the control valve 21 is closed by electrically energizing the coil of its armature, downward movement of the plunger 13 is immediately reflected in high pressurization of the fuel remaining in the chamber 14.

Figure 3:
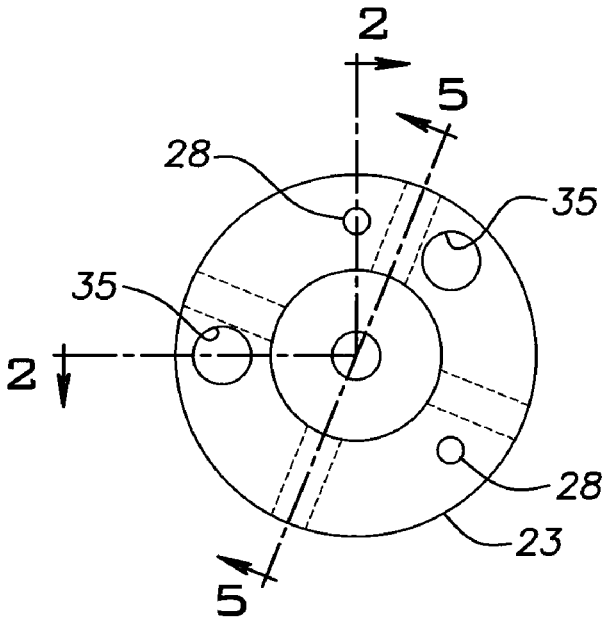
FIG. 3 is a view of the upper end of the spring cage.
Figure 4:
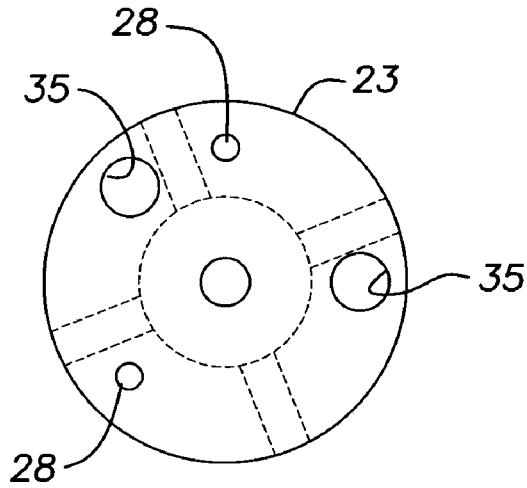
FIG. 4 is a view of the lower end of the spring cage.

The lower end of the cylindrical bore or chamber 14 is closed by a cylindrical spacer 22. Below the spacer 22 is a cylindrical spring cage 23 and below that is a circular spray tip 24. The spacer 22, spring cage 23, and spray tip 24 are held together and against the housing 16 by a nozzle nut 26 threaded onto the bottom of the housing. Aligned drilled passages 27, 28 and 29, through the spacer 22, spring cage 23, and circular spray tip 24 communicate with one another to deliver fuel from the pressure chamber 14 to a cavity 31 in the spray tip. While only one passage in each of these components is illustrated in FIG. 1, it will be understood that two identical passages exist in each of these components as is suggested in FIGS. 3 and 4. The angular orientation of the spacer 22, spring cage 23, and spray tip 24 relative to one another is maintained by axially oriented pins 34 received in aligned blind holes 35 at their interfaces. A needle valve 36 having a precision sliding fit in a central bore 37 in the spray tip 24 has a tapered end 38 that seals on a seat 39 in the spray tip 24 and controls discharge of fuel out of the spray tip through orifices 41 and into a combustion chamber.

The spring cage 23 is a cylindrical tube having an outer cylindrical surface 46 and an inner cylindrical surface 47 forming a boundary of the interior space 48 of the spring cage.

Assembled in the space 48 are a helical compression spring 51, a spring seat 52 at the lower end of the spring, and a shim 53 at its upper end. The spring seat 52 has a blind bore in which a reduced diameter stub of the needle valve fits. At its upper side, the spring seat 52 has a cylindrical shank 54 sized to fit into the inside diameter of the helical spring 51. When the spray tip 24, spring cage 23, and spacer 22 are held in place by the nozzle nut 26, the spring 51 is compressed to hold the needle valve 36 closed on the seat 39 with a predetermined force.

An annular chamber 56, formed between the nozzle nut 26 and body 16 receives pressurized fuel from the supply rail, e.g. at about 105 psi. This pressurized fuel communicates with an annular chamber 57 around the spacer through a flat 58 on a threaded area at the bottom of the housing 16. Similarly, flats 59 on diametrally opposite outer sides of the spacer communicate rail pressure fuel to the outer periphery of the spring cage 23.

Both the spray tip 24 and spacer 22 have outside diameters that produce a close fit with respective surrounding internal surfaces of the nozzle nut 26 so as to hold these elements concentric with the axis 11. The outside diameter of the spring cage 23, however, is significantly smaller than the inside diameter of the respective part of the nozzle nut 26. The axial locating pins 34 serve to hold the spring cage concentric with the axis 11.

In operation, the plunger 13 is driven downwardly with the force developed on the socket 12 by the engine's camshaft. Fuel in the chamber 14 below the plunger 13 is discharged through a side port in the chamber wall and through an internal passage to the control valve 21 and beyond to a return to the fuel tank. When the control valve 21 closes, fuel in the chamber 14 is immediately pressurized. This pressure is transmitted through the passages 27-29 to the cavity 31. The resulting high fuel pressure in the cavity 31 lifts the needle valve 36 against the force of the spring 51 whereupon fuel is injected into the engine cylinder through the spray tip orifices 41. A shoulder 64 on an upper end of the needle valve 36 abuts the spring cage 23 to limit opening movement of the needle valve. When the control valve 21 opens, the fuel pressure in the injector assembly 10 drops, the needle valve 36 closes and injection stops. This process repeats cyclically as the engine operates.

Figure 2:
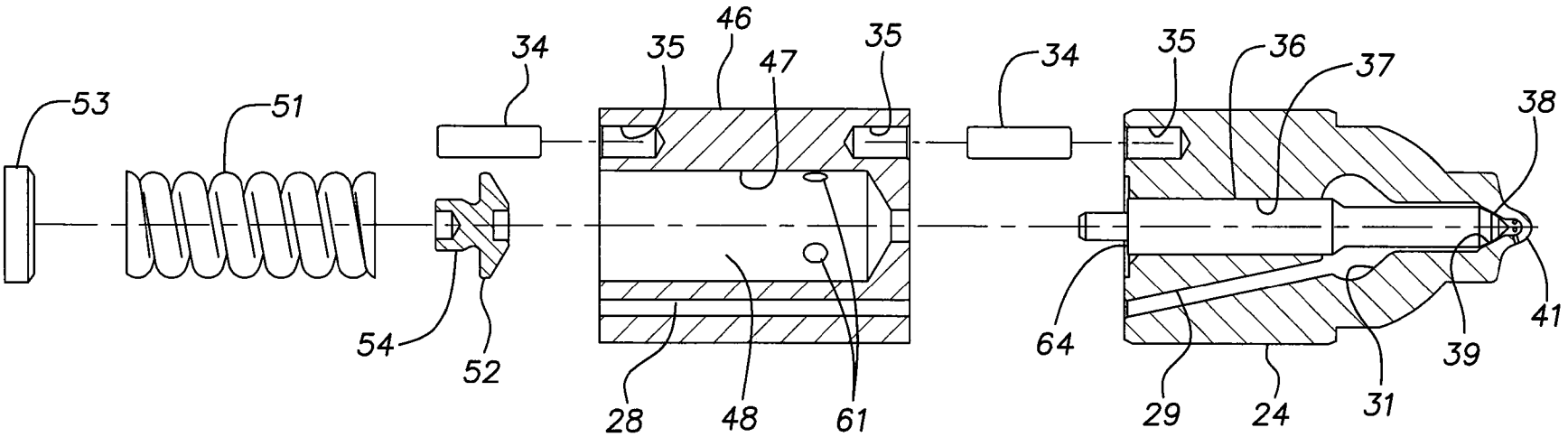
FIG. 2 is an exploded side view, partially in section, of elements of a kit including the novel spring cage (sectional in the planes indicated at the lines 2-2 in FIG. 3) of the invention for use in the assembly of FIG. 1.
Figure 5:
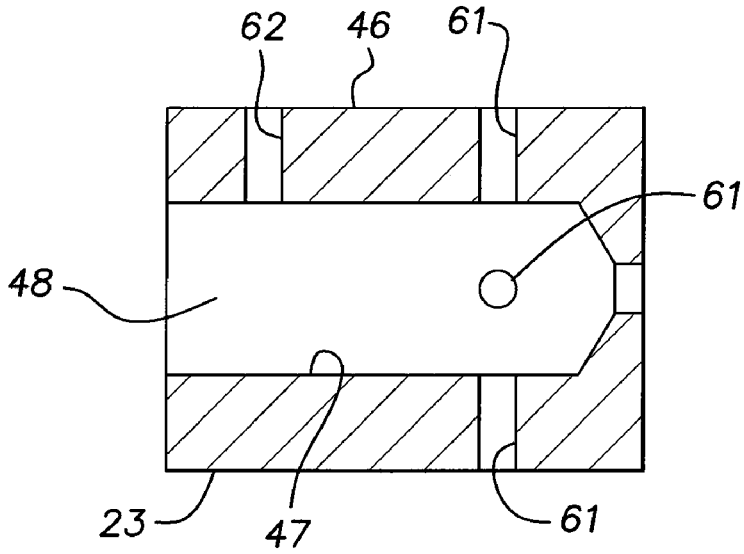
FIG. 5 is a longitudinal cross-sectional view of the spring cage taken in the plane indicated in FIG. 3 at the lines 5-5.

As a practical matter, pressurized fuel migrates along the needle valve 36 from the cavity 31 into the interior space 48 of the spring cage 23. The very rapid movement of the needle valve 36 and the spring seat 52 has been found to result in destructive cavitation producing erosion and failure of the needle valve spring in prior art electronic unit injectors. With reference to FIGS. 2 and 5, the spring cage 23 has a plurality of ports 61 through its cylindrical wall that have been found, surprisingly, to effectively eliminate cavitation with the spring cage particularly in the area around the spring seat 52. In one preferred arrangement, the ports 61 are distributed around the circumference of the spring cage 23 at four equally spaced locations in a plane perpendicular to the axis 11 and passing through the spring seat shank 54. Thus, the ports 61 are at the lower end of the spring cage 23 adjacent the spring seat 52. Supplementing these lower ports 61, is at least one additional port 62 in the spring cage wall adjacent the upper end of the spring 51. It is theorized that the tendency for fuel to cavitate in the area of the spring seat 52 is the result of sudden closing motion of the needle valve 36 caused by the requisite high force applied by the spring when the pressure in the cavity 31 drops following opening of the control valve 21. This jerk-like motion of the spring seat 52 requires a similar movement of fuel directly behind it. By locating the ports 61 at or adjacent the plane of the spring seat 52 and maintaining the fuel at these ports above atmospheric pressure, i.e. at the level of the fuel supply rail, it is believed that a sufficient quantity of fuel at a sufficient positive pressure is maintained behind the space vacated by the spring seat as it drives the needle valve closed. An annular space 60 between the nozzle nut 26 and spring cage 23 serves as a fuel reservoir to instantaneously feed fuel to the space 48 or interior of the spring cage 23 through the ports 61 should a localized low pressure condition occur behind the spring seat 52 as the spring 51 snaps the needle valve 36 closed. A factor in effective avoidance of cavitation is the collective cross-sectional area of the ports 61 being at least a significant fraction of the cross-sectional area of the spring seat 52. In the illustrated arrangement, the spring seat 52 has a nominal diameter of 0.392" and the collective area of the ports 61 is at least about ¼ the cross-sectional area of the spring seat. Further, the ID of the nozzle nut is nominally 0.965" and the OD of the spring cage is nominally 0.933" leaving a cross-sectional area of the reservoir space between these surfaces approximately 4/10 of the area of the spring seat 52. The upper port 62 can have the same diameter as that of the lower ports 61. The reciprocating motion of the spring seat 52 as it follows the motion of the needle valve 36 can induce currents in the fuel in the spring cage 23 through the ports 61, 62 with the result of an improvement in heat transfer, thereby reducing temperature and, therefore, the risk of cavitation of fuel in the spring cage.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. An electronic unit injector comprising a housing with a fuel pressure chamber, a mechanically operated plunger reciprocating in the housing chamber to pressurize fuel in the chamber, an electronically controlled valve for venting fuel from the chamber when it is open and thereby preventing high pressurization of fuel in the chamber by the plunger and allowing the plunger to pressurize fuel in the chamber to an injection pressure when it is closed, a spray tip including a valve seat communicating with the fuel pressurization chamber, a needle valve arranged to close on the seat to prevent discharge of fuel from the spray tip or to open off the seat to dispense fuel from the spray tip, a spring biasing the needle valve to a closed position on the valve seat, a spring seat disposed between the spring and the needle valve, the needle valve being arranged to overcome the biasing force of the spring when the pressure in the pressure chamber reaches a predetermined level as a result of the electronically controlled valve closing, the spring and seat being disposed in a cage, the cage having a port area circumferentially arranged about said spring and said spring seat to allow fuel from a low pressure source to supply fuel to the area occupied by said spring and spring seat to reduce the risk of cavitation in said spring cage, said cage having a cylindrical wall and said port area comprising a series of radial holes distributed about the circumference of said cylindrical wall, the collective area of said holes being at least about one-quarter of the area of the spring seat.

2. An electronic unit injector comprising a housing with a fuel pressure chamber, a mechanically operated plunger reciprocating in the housing chamber to pressurize fuel in the chamber, an electronically controlled valve for venting fuel from the chamber when it is open and thereby preventing high pressurization of fuel in the chamber by the plunger and allowing the plunger to pressurize fuel in the chamber to an injection pressure when it is closed, a spray tip including a valve seat communicating with the fuel pressurization chamber, a needle valve arranged to close on the seat to prevent discharge of fuel from the spray tip or to open off the seat to dispense fuel from the spray tip, a spring biasing the needle valve to a closed position on the valve seat, a spring seat disposed between the spring and the needle valve, the needle valve being arranged to overcome the biasing force of the spring when the pressure in the pressure chamber reaches a predetermined level as a result of the electronically controlled valve closing, the spring and seat being disposed in a cage, the cage having a port area circumferentially arranged about said spring and said spring seat to allow fuel from a low pressure source to supply fuel to the area occupied by said spring and spring seat to reduce the risk of cavitation in said spring cage, said spring cage having port areas adjacent said spring seat and remote from said spring seat whereby circulation of fuel through said spring cage can be induced by movement of said spring seat.

3. An electronic unit injector comprising a housing with a fuel pressure chamber, a mechanically operated plunger reciprocating in the housing chamber to pressurize fuel in the chamber, an electronically controlled valve for venting fuel from the chamber when it is open and thereby preventing high pressurization of fuel in the chamber by the plunger and allowing the plunger to pressurize fuel in the chamber to an injection pressure when it is closed, a spray tip including a valve seat communicating with the fuel pressurization chamber, a needle valve arranged to close on the seat to prevent discharge of fuel from the spray tip or to open off the seat to dispense fuel from the spray tip, a spring biasing the needle valve to a closed position on the valve seat, a spring seat disposed between the spring and the needle valve, the needle valve being arranged to overcome the biasing force of the spring when the pressure in the pressure chamber reaches a predetermined level as a result of the electronically controlled valve closing, the spring and seat being disposed in a cage, the cage having a port area circumferentially arranged about said spring and said spring seat to allow fuel from a low pressure source to supply fuel to the area occupied by said spring and spring seat to reduce the risk of cavitation in said spring cage, said cage having a cylindrical wall and said port area comprising a series of radial holes distributed about the circumference of said cylindrical wall, said spring cage being surrounded by an annular space having a cross-sectional area of at least one-quarter of an area of the spring seat.

4. A kit for use in an electronic unit injector comprising a circular spray tip having a major diameter outer surface, a valve seat, and a bore concentrically arranged about an axis, a needle valve receivable in said bore with a precision sliding fit, a spring cage adapted to abut a rear face of the spray tip and limit opening movement of the needle valve, the spring cage being formed by a circular tubular wall, a shim, a spring, and a spring seat receivable in the spring cage, the spring cage and spray tip being adapted to be retained in an operating position, with the needle valve in the spray tip and the spring cage, and with the spring seat, spring and shim in the spring cage, by a nozzle nut threaded with an injector body, the spring cage being smaller in diameter than the spray tip, the spring cage having a port area formed by a plurality of circumferentially disposed ports in its wall for permitting free communication of fuel between the outside and inside of the spring cage whereby the risk of cavitation in the spring cage is reduced.

5. A kit as set forth in claim 4, wherein said ports are axially proximate to said spring seat when the kit is in an assembled state.

6. A kit as set forth in claim 5, wherein said port area includes a location remote from said spring seat so as to provide circulation of fuel through said spring cage as a result of movement of said spring seat during opening and closing movement of said needle valve.

* * * * *